US006116693A

United States Patent [19]

Zammit

[11] Patent Number: 6,116,693

[45] Date of Patent: Sep. 12, 2000

[54] REMOVABLE SEAT CUSHION SYSTEM

[76] Inventor: John Zammit, P.M.B. 2, Providencials, Turks/Caicos Islands

[21] Appl. No.: 09/113,047

[22] Filed: Jul. 9, 1998

[51] Int. Cl.[7] ..... A47C 7/00

[52] U.S. Cl. ..... 297/440.22; 297/218.3; 297/DIG. 6

[58] Field of Search ..... 297/452.48, DIG. 6, 297/219.1, 228.13, 440.22, 452.52, 218.1, 218.3, 218.2

[56] References Cited

U.S. PATENT DOCUMENTS

| | | |
|---|---|---|
| 2,218,951 | 10/1940 | Flaharty . |
| 2,895,542 | 7/1959 | Schutte . |
| 2,924,833 | 2/1960 | Klogether . |
| 3,603,639 | 9/1971 | Wilson . |
| 4,365,840 | 12/1982 | Kehl et al. . |
| 4,568,124 | 2/1986 | Kanai . |
| 5,007,676 | 4/1991 | Lien . |
| 5,088,747 | 2/1992 | Morrison et al. . |
| 5,322,349 | 6/1994 | Gianino . |

FOREIGN PATENT DOCUMENTS

| | | |
|---|---|---|
| 1016025 | 10/1952 | France . |

*Primary Examiner*—Milton Nelson, Jr.
*Attorney, Agent, or Firm*—Harter, Secrest & Emery LLP; Stephen B. Salai

[57] ABSTRACT

A removable seat cushion system for movable furniture includes a seat cushion generally in the shape of a rectangular parallelepiped having a bottom surface, a rear top edge, and a front bottom edge. Attached to the seat cushion is a rear tab for securing the seat cushion to the frame, the rear tab extending from the seat cushion adjacent the rear top edge of the seat cushion, and having a free edge and a bottom surface. Also attached to the seat cushion is a front tab for securing the seat cushion to the frame, the front tab extending from the seat cushion adjacent the front bottom edge of the seat cushion, and having a free edge and a rear surface. Attached to the rear and front tabs are fasteners for securing the tabs to the frame.

4 Claims, 2 Drawing Sheets

REMOVABLE SEAT CUSHION SYSTEM

FIELD OF INVENTION

The present invention relates to a removable seat cushion system for movable furniture.

BACKGROUND OF THE INVENTION

Movable furniture is furniture that is changeable between two or more shapes or positions. A common example is a reclining chair that is movable between upright and reclining positions.

During the manufacture of movable furniture, such as a reclining chair, upholstering is generally accomplished by "permanently" attaching the upholstery cloth to the frame of the moveable furniture using staples or similar means. The upholstering process is generally performed by hand.

One problem with the above described method of manufacturing movable furniture is that since the upholstering of each piece of movable furniture is performed by hand, and often by more than one upholsterer, the characteristics of the final product vary from piece to piece. It is important that the quality and characteristics of upholstered moveable furniture be as consistent as possible. For example, it is important that a chair have a "tight seat", that is, that the seat fit closely to the frame and to the armrests and other surrounding components of the chair.

Another problem associated with such method of manufacturing movable furniture is that the upholstering is a time consuming and therefore expensive process requiring the use of skilled upholsterers. It is important that furniture manufacturers be able to manufacture upholstered moveable furniture as quickly and cheaply as possible.

Since upholstering is generally accomplished by permanently attaching the upholstery cloth to the frame, a further problem associated with this method of manufacturing movable furniture is that it is difficult to remove upholstered parts of movable furniture, such as chair cushions. Thus, in order to repair upholstered moveable furniture, it is generally necessary to transport the entire piece of furniture to the manufacturer or a professional upholsterer. Movable furniture is generally heavy and large, and it is therefore usually inconvenient and expensive to transport such furniture for repair. Alternatively, a professional upholsterer must travel to the chair, also an expensive proposition.

SUMMARY OF THE INVENTION

An object of the invention is to provide an improved seat cushion system for movable furniture.

A second object of the invention is to provide a seat cushion system for movable furniture that is quicker and cheaper to manufacture than known systems.

A third object of the invention is to provide a seat cushion system for movable furniture that enables such furniture to be manufactured with consistent quality and physical characteristics.

A fourth object of the invention is to provide a seat cushion system for movable furniture that is easier to clean and repair.

The present invention provides a seat cushion that is removably attachable to the frame of a piece of moveable furniture. According to the invention, there is provided a removable seat cushion system for movable furniture having a frame, comprising: a seat cushion; and opposing tabs attached to the seat cushion for securing the cushion to the frame.

According to the invention, there is further provided a removable seat cushion system for movable furniture having a frame, comprising: a seat cushion generally in the shape of a rectangular parallelepiped having a bottom surface, a rear top edge, and a front bottom edge; a rear tab for securing the cushion to the frame, the rear tab extending from the cushion adjacent the rear top edge of the cushion, and the rear tab having a free edge and a bottom surface; a front tab for securing the cushion to the frame, the front tab extending from the cushion adjacent the front bottom edge of the cushion, the bottom tab having a free edge and a rear surface; rear securing means for securing the rear tab to the frame; and front securing means for securing the front tab to the frame.

Among the advantages associated with the invention are the following. First, the invention enables movable furniture to be manufactured quicker and cheaper than is currently possible. Second, the invention enables movable furniture to be more easily manufactured with consistent quality and physical characteristics. Third, the invention enables movable furniture to be more easily cleaned and repaired.

Other advantages, objects and features of the present invention will be readily apparent to those skilled in the art from a review of the following detailed description of preferred embodiments of the invention in conjunction with the accompanying drawing and claims.

BRIEF DESCRIPTION OF THE DRAWINGS

The embodiments of the invention will now be described with reference to the accompanying drawings, in which.

DETAILED DESCRIPTION OF THE INVENTION

Figure 1:
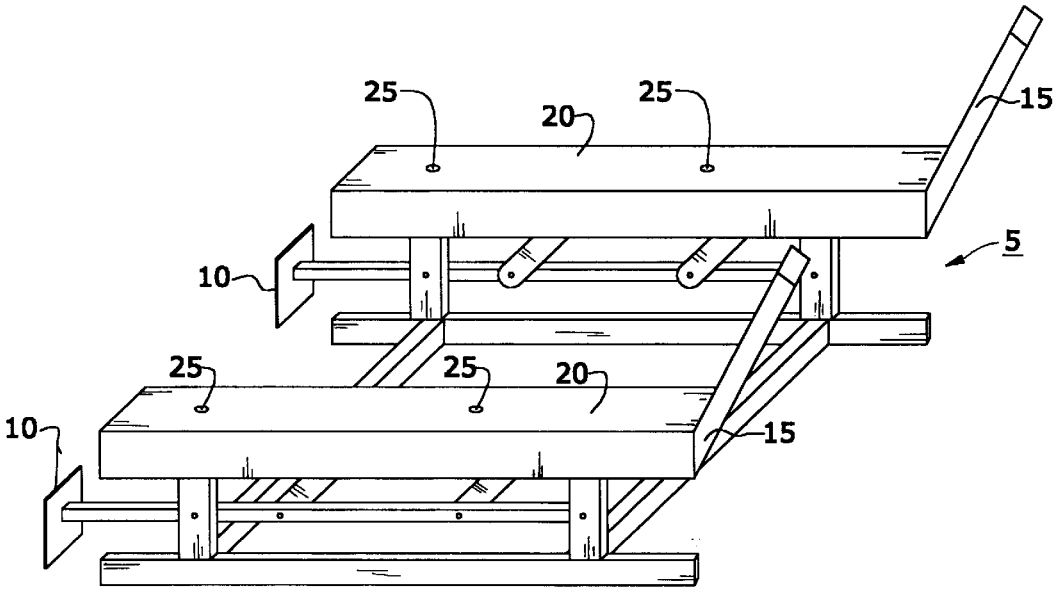
FIG. 1 is a perspective view of a motion mechanism of a reclining chair.
Figure 2:
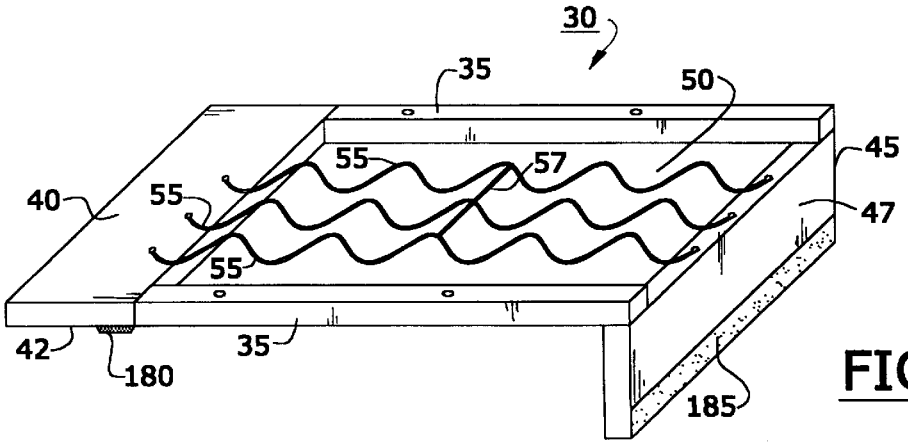
FIG. 2 is a perspective view of a seat frame of a reclining chair.

A typical example of a piece of movable furniture is a reclining chair. FIGS. 1 and 2 illustrate certain components of a reclining chair that relate to the present invention.

Reclining chairs generally include a motion mechanism 5, as shown in FIG. 1. The motion mechanism 5 is a frame, generally constructed primarily of metal components, that enables the chair to move between an upright position and a reclined position. The footrest bracket 10 is designed to support the chairs' footrest, and moves outward and upward as the chair is moved from the upright position to the reclined position. The backrest bracket 15 is designed to support the chair's backrest, and moves outward and downward as the chair is moved from the upright position to the reclined position. The motion mechanism 5 includes two supports 20. Each support 20 includes two holes 25 for receiving fasteners for the purpose of attaching a seat frame 30, shown in FIG. 2, to the motion mechanism 5.

Referring to FIG. 2, the seat frame 30 includes mounting supports 35 for attachment to the motion mechanism 5 by way of fasteners that pass through the holes 25 in the supports 20. Extending across the front of the seat frame 30 is a front board 40 having a bottom surface 42. Extending across the rear of the seat frame 30 is a rear board 45 having a rear surface 47. In the illustrated embodiment, both the front board 40 and rear board 45 are one inch by three inch hardwood boards approximately two feet in length. The length of the front board 40 and rear board 45 generally depends upon the size of the particular reclining chair of which they are a part. Extending between the front board 40 and rear board 45 is a spring system 50. The spring system 50 includes elongate springs 55 that are attached to the front board 40 and rear board 45. The elongate springs 55 extend generally parallel to the mounting supports 35. Extending across and attached to the elongate springs 55 is a wire fastener 57 for controlling the spacing of the elongate springs 55.

Figure 3:
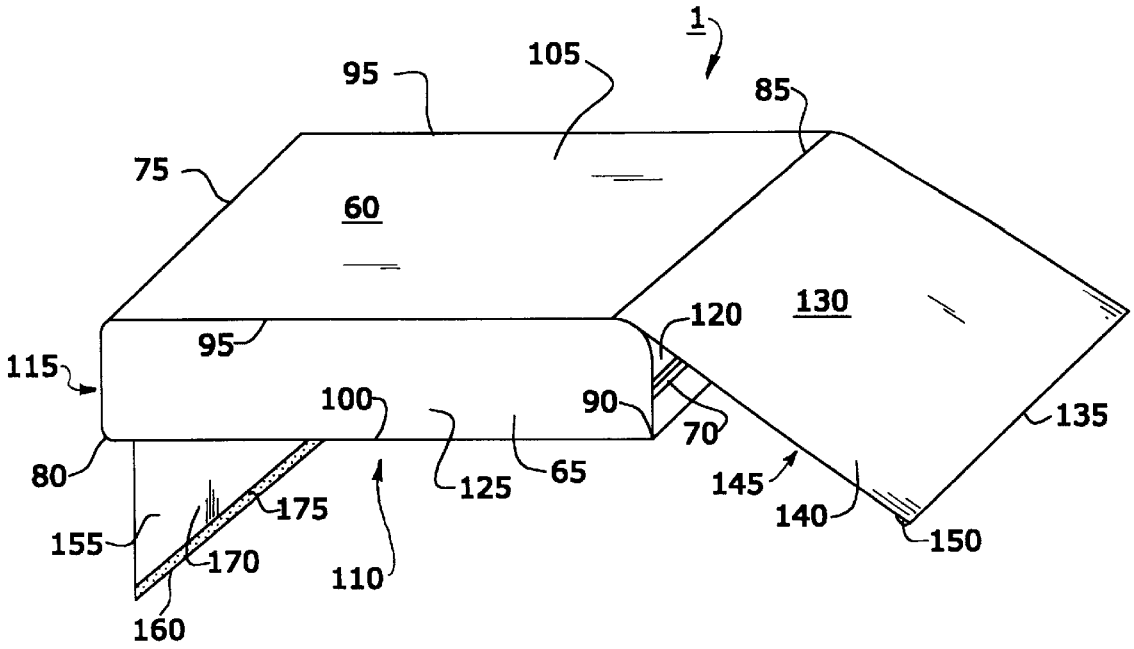
FIG. 3 is a perspective view of an embodiment of the invention.

Referring to FIG. 3, a removable seat cushion system 1 includes a seat cushion 60. The seat cushion 60 is constructed of a block of foam and an outside cover 65. The outside cover 65 is typically constructed of cloth, vinyl, leather, or the like, and includes a zipper 70 to facilitate insertion and removal of the foam block with respect to the outside cover 65. The seat cushion 60 is generally in the shape of a rectangular parallelepiped having a front top edge 75, a front bottom edge 80, a rear top edge 85, a rear bottom edge 90, two top side edges 95, two bottom side edges 100, a top surface 105, a bottom surface 110, a front surface 115, a rear surface 120, and two side surfaces 125. Note that the corners of the seat cushion 60 corresponding to front top edge 75 and the rear top edge 85 are rounded. The seat cushion 60 is therefore not a true parallelepiped, but rather generally in the shape of a rectangular parallelepiped. Although the seat cushion of the preferred embodiment is generally in the shape of a rectangular parallelepiped, the invention is applicable to a seat cushion of any size or shape.

Figure 4:
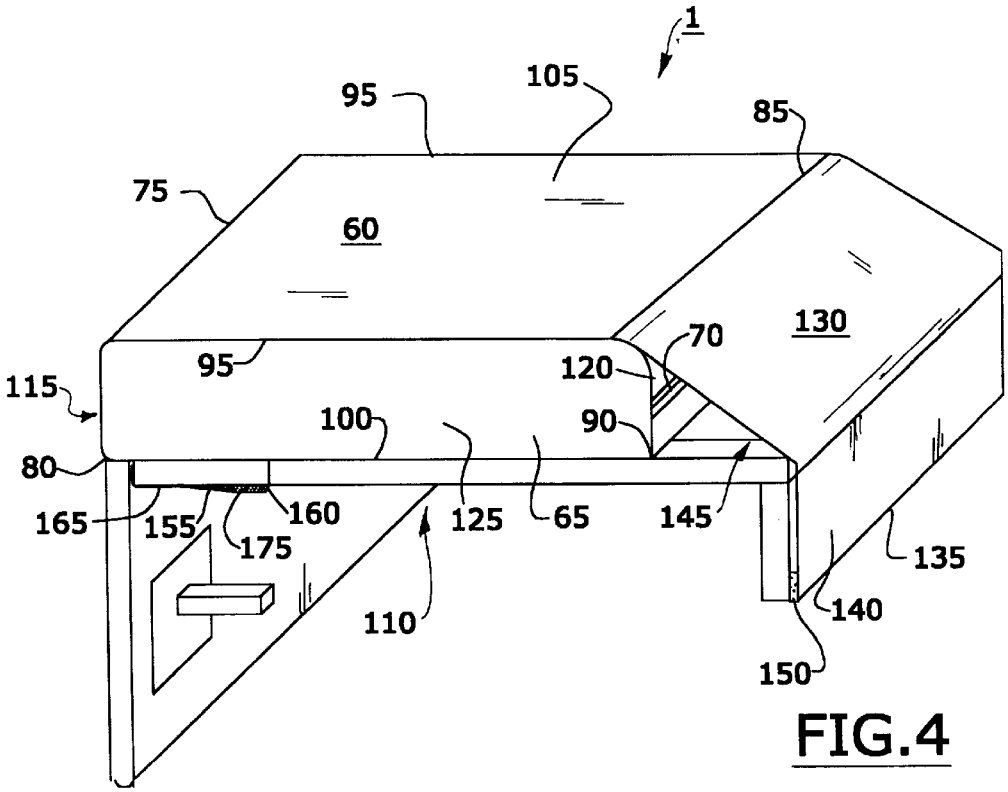
FIG. 4 is a perspective view of an embodiment of the invention attached to the seat frame of a reclining chair.

The seat cushion system 1 includes a rectangular rear tab 130. The rear tab 130, which is preferably constructed of the same material as the outside cover 65, is attached to the rear top edge 85 of the seat cushion 60. In the embodiment of FIG. 3, the rear tab 130 extends along a portion of the rear top edge 85. In the embodiment of FIG. 4, the rear tab 130 extends along the full length of the rear top edge 85. The rear tab 130 has a free edge 135, a top surface 140, and a bottom surface 145. Attached to the bottom surface 145 adjacent the free edge 135 is a strip of hook material 150 for a hook and loop fastener system.

The seat cushion system 1 also includes a rectangular front tab 155. The front tab 155, which is preferably constructed of the same material as the outside cover 65, is attached to the front bottom edge 80 of the seat cushion 60. The front tab 155 has a free edge 160, a front surface 165, and a rear surface 170. Attached to the rear surface 170 adjacent the free edge 160 is a strip of hook material 175 for a hook and loop fastener system.

Referring to FIG. 2, a strip of loop material 180 for a hook and loop fastener system is attached to the bottom surface 42 of the front board 40. Similarly, a strip of loop material 185 for a hook and loop fastener system is attached to the rear surface 47 of the rear board 45.

FIG. 4 illustrates the cushion 60 attached to the seat frame 30. To attach the cushion 60 to the seat frame 30, the cushion 60 is placed on the seat frame 30 such that it rests on the mounting supports 35, the front board 40, and the spring system 50. The front tab 155 is wrapped around the front board 40 such that the hook material 175 on the front tab 155 engages and attaches to the loop material 180 on the front board 40. The rear tab 130 is wrapped tightly around the rear board 45 such that the hook material 150 on the rear tab 130 engages and attaches to the loop material 185 on the rear board 45.

The cushion 60 is thus securely attached to the seat frame 30. The process of attaching the cushion to the seat frame 30 is quick and efficient from a manufacturing point of view. A tight seat can be achieved more quickly and easily than with conventional manufacturing techniques. The cushion 60 is easily removed for cleaning or repairing, and is then easily reattached to the seat frame 30. The front tab 155 covers and conceals the front board 40. The rear tab 130 covers and conceals the rear board 45 and the portion of the mounting supports 35 and spring system 50 not covered by the cushion 60.

In alternative embodiments of the invention, the seat cushion system could include additional tabs, located, for example, at the sides of the seat cushion 60. Such side tabs could even replace the rear tab 130 and front tab 155 of the illustrated embodiments.

Numerous modifications, variations and adaptations may be made to the particular embodiments of the invention described above without departing from the scope of the invention, which is defined in the claims.

I claim:

1. A removable upholstered cushion for use with a reclining chair that has a substantially rectangular seating frame with a front edge, a rear edge, a substantially planar top surface, a substantially planar bottom surface adjacent the front edge thereof, and a substantially planar rear edge surface, said planar bottom surface adjacent the front edge and said rear edge surface each being provided with a strip of hook or loop fastening material thereon; said upholstered cushion comprising:

an upholstery cover having front upper and lower edges, rear upper and lower edges, and front and rear tabs extending therefrom, the front tab extending from the lower front edge of said cover and connectable to the strip of hook or loop fastening material on the planar bottom surface adjacent the front edge of the frame, the rear tab extending from the upper rear edge of said cover and connectable to the strip of hook or loop fastening material on the rear edge surface of the frame, the undersurface of said tabs each being provided with a strip of hook or loop fastening material complementary to the respective fastening material strips on said frame surfaces;

a relatively thick resiliently compressible body inserted within the upholstery cover, the rear tab extending across the entire upper rear edge of said cushion, whereby said cushion is adapted to be attached to said substantially rectangular seating frame by wrapping the front tab around the frame bottom surface adjacent the front edge and engaging the complementary fastening material strips on the front tab and the frame bottom surface and wrapping tightly the rear tab around the frame rear edge surface and engaging the complementary fastening material strips on the rear tab and the rear edge surface.

2. A removable upholstered cushion as defined in claim 1, wherein the front and rear tabs are each rectangular in shape.

3. The removable seat cushion system of claim 1, wherein the resiliently compressible body is a foam block.

4. The removable upholstered cushion of claim 1, including a zipper in a rear surface of the cushion cover.

* * * * *

UNITED STATES PATENT AND TRADEMARK OFFICE

CERTIFICATE OF CORRECTION

PATENT NO. : 6,116,693
DATED : September 12, 2000
INVENTOR(S) : John Zammit

It is certified that error appears in the above-indentified patent and that said Letters Patent is hereby corrected as shown below:

On the title page:

[30] Foreign Application Priority Data

Jan. 21, 1998 Canada.....2,221,327

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*